US005445727A

United States Patent [19]

Schwendemann et al.

[11] Patent Number: 5,445,727

[45] Date of Patent: Aug. 29, 1995

[54] PRODUCTION OF NICKELIZED SHAPED ARTICLES

[75] Inventors: Volker Schwendemann, Neustadt; Klaus Glaser, Mannheim; Chung-Ji Tschang, Bad Duerkheim; Bernd Burkhart, Mutterstadt; Alfred Oftring, Bad Duerkheim; Bernhard Dung, Gruenstadt, all of Germany

[73] Assignee: BASF Aktiengesellschaft, Ludwigshafen, Germany

[21] Appl. No.: 256,374

[22] PCT Filed: Jan. 14, 1993

[86] PCT No.: PCT/EP93/00063

§ 371 Date: Jul. 25, 1994

§ 102(e) Date: Jul. 25, 1994

[87] PCT Pub. No.: WO93/15241

PCT Pub. Date: Aug. 5, 1993

[30] Foreign Application Priority Data

Jan. 25, 1992 [DE] Germany ..... 42 02 003.4

[51] Int. Cl.[6] ..... C25D 3/16; C25D 3/18

[52] U.S. Cl. ..... 205/271; 205/279

[58] Field of Search ..... 205/181, 271, 279, 259

[56] References Cited

U.S. PATENT DOCUMENTS 3,758,389 9/1973 Maekawa ..... 204/181

3,862,019 1/1975 Rosenberg et al. ..... 204/279

FOREIGN PATENT DOCUMENTS 1191652 5/1963 Germany .

OTHER PUBLICATIONS

"Praktische Galvanotechnik", Eugen G. Lenze Verlag, Saulgau, 4th ed. (1984), pp. 268–271 No Month.

*Primary Examiner*—John Niebling

*Assistant Examiner*—Edna Wong

*Attorney, Agent, or Firm*—Oblon, Spivak, McClelland, Maier, & Neustadt

[57] ABSTRACT

Nickelized shaped articles are produced by electrodeposition of nickel from aqueous acidic baths containing as essential constituents one or more nickel salts, one or more inorganic acids and at least two brighteners by using as brighteners a mixture of A) from 2 to 98% by weight of one or more cyclic N-allylammonium or N-vinylammonium compounds I

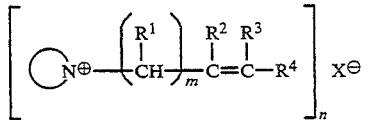

(I)

where the nitrogen atom is part of a pyridine, quinoline or isoquinoline ring system which may additionally carry one or two $C_1$- to $C_4$-alkyl substituents or halogen atoms, $R^1$, $R^3$ and $R^4$ are each hydrogen or $C_1$- to $C_4$-alkyl, $R^2$ is hydrogen or methyl, m is from 0 to 4, n is from 1 to 4, and $X^{\ominus}$ is an n-valent inorganic or organic anion which promotes solubility in water, and B) from 98 to 2% by weight of one or more acetylenically unsaturated compounds II $$R^4—C{\equiv}C—R^5 \quad \text{(II)}$$

where $R^4$ and $R^5$ are identical or different and each is $C_1$- to $C_4$-alkyl substituted by hydroxyl, sulfo, amino, $C_1$- to $C_4$-alkylamino or di($C_1$- to $C_4$-alkyl)amino, although hydroxyl groups may have been reacted with from 1 to 10 mol of a $C_2$- to $C_4$-alkylene oxide or a mixture of such alkylene oxides and one of the radicals $R^4$ and $R^5$ may also be hydrogen or $C_1$- to $C_4$-alkyl.

5 Claims, No Drawings

PRODUCTION OF NICKELIZED SHAPED ARTICLES

The present invention relates to an improved process for producing nickelized shaped articles by electrodeposition of nickel from aqueous acidic baths containing as essential constituents one or more nickel salts, one or more inorganic acids and at least two brighteners, and to a brightener mixture usable for this purpose.

It is known that acidic nickel electrolytes must contain small amounts of organic substances if the electronickelization is to produce a bright, ductile and surface-planar deposition of the metal. Such brighteners, which in general are divided into primary and secondary brighteners, are customarily used in the form of combinations comprising a plurality of these agents in order to enhance the effect.

Praktische Galvanotechnik, Eugen G. Lenze Verlag, Saulgau, 4th edition 1984, pages 268 to 271 (1) describes customary brighteners for nickel electrolytes. Although the compounds are classified as primary or secondary brighteners or planarizers, it is admitted at the same time that clear-cut classification is not always possible. The brightening compounds mentioned are:

sulfonimides, eg. benzoic sulfimide
sulfonamides
benzenesulfonic acids, eg. mono-, di- and tri-benzenesulfonic acid
naphthalenesulfonic acids, eg. mono-, di- and tri-naphthalenesulfonic acid
alkylsulfonic acids
sulfinic acid
arylsulfone sulfonates
aliphatic compounds with ethylene and/or acetylene bonds, eg. butynediol
single- and multiring nitrogen-containing heterocycles with or without further hetero atoms such as
sulfur or selenium
coumarin
amines and quaternary ammonium compounds as planarizing agents
saccharin.

DE-B-1 191 652 (2) describes single- or multiring heterocyclic nitrogen bases of the aromatic type in quaternized form such as pyridinium salts, eg. 2-pyridinium-1-sulfatoethane, as planarizers, ie. brighteners, for acidic nickel-plating baths. These agents are used together with customary basic brighteners such as benzene-m-disulfonic acid, diaryldisulfimides or sulfonamides.

U.S. Pat. No. 2,647,866 (3) describes mixtures of N-substituted pyridinium compounds, eg. N-allylpyridinium or N-methallylpyridinium halides, with certain sulfur-containing compounds, eg. allylsulfonic acid, as highly effective brighteners in the electrodeposition of nickel. A use concentration of from 4 to 12 g/l is recommended for allylsulfonic acid.

However, the prior art agents generally need to be used in relatively high concentrations in the nickel electrolyte baths used; what is more, the brightness and planarization achievable with these agents are still in need of improvement.

It is an object of the present invention to remedy the aforementioned defects of the prior art.

We have found that this object is achieved by a process for producing nickelized shaped articles by electrodeposition of nickel from aqueous acidic baths containing as essential constituents one or more nickel salts, one or more inorganic acids and at least two brighteners, which comprises using as brighteners a mixture of A) from 2 to 98% by weight of one or more cyclic N-allylammonium or N-vinylammonium compounds of the general formula I

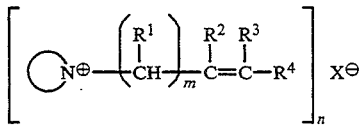

(I)

where the nitrogen atom is part of a pyridine, quinoline or isoquinoline ring system which may additionally carry one or two $C_1$- to $C_4$-alkyl substituents or halogen atoms, $R^1$, $R^3$ and $R^4$ are each hydrogen or $C_1$- to $C_4$-alkyl, $R^2$ is hydrogen or methyl, m is from 0 to 4, n is from 1 to 4, and $X^{\ominus}$ is an n-valent inorganic or organic anion which promotes solubility in water, and B) from 98 to 2% by weight of one or more acetylenically unsaturated compounds of the general formula II $$R^4—C\equiv C—R^5 \quad (II)$$

where $R^4$ and $R^5$ are identical or different and each is $C_1$- to $C_4$-alkyl substituted by hydroxyl, sulfo, amino, $C_1$- to $C_4$-alkylamino or di($C_1$- to $C_4$-alkyl)-amino, although hydroxyl groups may have been reacted with from 1 to 10 mol of a $C_2$- to $C_4$-alkylene oxide or a mixture of such alkylene oxides and one of the radicals $R^4$ and $R^5$ may also be hydrogen or $C_1$-to $C_4$-alkyl.

Suitable $C_1$- to $C_4$-alkyl radicals are in general n-propyl, isopropyl, n-butyl, isobutyl, sec-butyl, tertbutyl and in particular methyl and ethyl.

Examples of alkyl- or halogen-substituted heterocycli ring systems for I are:

2-, 3- or 4-methylpyridinium,
2-, 3- or 4-chloropyridinium,
2-, 3- or 4-bromopyridinium,
2-, 3- or 4-ethylpyridinium,
3- or 4-n-propylpyridinium,
3- or 4-isopropylpyridinium,
3- or 4-n-butylpyridinium,
4-tert-butylpyridinium,
2,3-, 2,4-, 2,5-, 2,6-, 3,4- or 3,5-dimethylpyridinium,
3-methyl-4-isopropylpyridinium,
4-tert-butyl-3-methylpyridinium,
2-, 3-, 4-, 5-, 6-, 7- or 8-methylquinolinium,
2- or 6-bromoquinolinium,
2,4-dichloroquinolinium,
2,4-, 2,8- or 5,8-dimethylquinolinium and
1-, 3-, 4-, 5-, 6-, 7- or 8-methylisoquinolinium.

The term halogen atom herein encompasses fluorine, iodine and in particular bromine and chlorine.

Preference is given to unsubstituted pyridinium.

$R^1$, $R^3$ and $R^4$ are preferably each hydrogen.

The variable m is preferably 1.

Suitable n-valent anions X are the customary, normally water-solubilizing inorganic or organic anions, in particular chloride, bromide, fluoride, sulfate, hydrogensulfate, methanesulfonate, trifluoromethanesulfonate, 2-hydroxyethanesulfonate, p-toluenesulfonate, nitrate, tetrafluoroborate, perchlorate, 1-hydroxyethane-1,1-diphosphonate, dihydrogenphosphate, phosphate, formate, acetate, oxalate and tartrate.

Of these, anions with one or two charges (n=1 or 2) are preferred, in particular fluoride, sulfate, methanesulfonate, nitrate and tetrafluoroborate but especially chloride and bromide.

In a preferred embodiment, component A comprises cyclic N-allylammonium compounds of the general formula

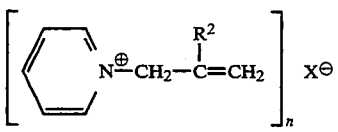

(Ia)

where $R^2$, n and $X^{\ominus}$ are each as defined above.

The cyclic N-allylammonium or N-vinylammonium compounds I and Ia are best prepared in a conventional manner by reacting the corresponding precursor of the general formula

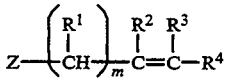

(III)

where Z is a nucleofugic leaving group, preferably chlorine or bromine, with a heterocycle of the general formula IV

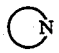

(IV)

and if desired subsequently exchanging the anion $Z^{\ominus}$ for $X^{\ominus}$.

The reaction of components III and IV is advantageously carried out in an inert organic solvent such as toluene, xylene, petroleum ether, naphtha, cyclohexane, acetone, tetrahydrofuran, dioxane, methanol, ethanol, isopropanol, ethyl acetate or methyl benzoate or in a mixture thereof. However, the reaction can also be carried out in water or in a single-phase or two-phase mixture of water and one or more organic solvents. In the case of two-phase mixtures it is possible to use a customary phase transfer catalyst. The reaction is in general carried out at from 40° to 130° C., in particular at from 60° to 110° C., under atmospheric pressure.

Component B comprises acetylenically unsaturated compounds II which carry at least one polar functional group, preferably in the α-position of the $C_1$- to $C_4$-alkyl radicals. Nonfunctionalized acetylenically unsaturated hydrocarbons are unsuitable, mainly because of their low solubility in aqueous media and because of their high volatility.

If hydroxyl-containing compounds II are used, they may have been alkoxylated with a $C_2$- to $C_4$-alkylene oxide such as ethylene oxide, propylene oxide or butylene oxide or a mixture of such alkylene oxides. If alkoxylated, the degree of alkoxylation is preferably from 1 to 3, in particular 1.

Sulfo-containing compounds II can be used in the form of the free acid or preferably in the form of their alkali metal, e.g. sodium or potassium, salts or ammonium salts.

In a preferred embodiment, component B comprises acetylenically unsaturated compounds II where $R^4$ and $R^5$ are identical or different and each is hydroxyl-, sulfo-, dimethylamino- or diethylamino-substituted methyl or ethyl, although hydroxyl groups may have been reacted with from 1 to 3 mol of a $C_2$- to $C_4$-alkylene oxide or a mixture of such alkylene oxides and one of the radicals $R^4$ and $R^5$ may also be hydrogen, methyl or ethyl.

Examples of compounds II are:
prop-2-yn-1-ol,
but-2-yne-1,4-diol,
hex-3-yne-2,5-diol,
prop-2-yn-1-ol ethoxylate,
prop-2-yn-1-ol propoxylate,
but-2-yne-1,4-diol monoethoxylate,
but-2-yne-1,4-diol diethoxylate,
but-2-yne-1,4-diol monopropoxylate,
but-2-yne-1,4-diol dipropoxylate,
prop-2-yne-1-sulfonic acid,
1-dimethylaminoprop-2-yne,
1-diethylaminoprop-2-yne,
1-diethylaminopent-2-yn-4-ol and
1-amino-1,1-dimethylprop-2-yne.

The terms ethoxylate, monoethoxylate, diethoxylate, propoxylate, monopropoxylate and dipropoxylate in each case denote the reaction products with 1 mol of alkylene oxide per hydroxyl group on the compounds II.

The mixture of the cyclic N-allylammonium or N-vinylammonium compounds I and the acetylenically unsaturated compounds II preferably comprises from 10 to 90% by weight, in particular from 25 to 75% by weight, of component A and from 90 to 10% by weight, in particular from 75 to 25% by weight, of component B. Very particular preference is given to a mixture of from 28 to 50% by weight of A and from 72 to 50% by weight of B.

In a preferred embodiment, component A is a mixture of one or more cyclic N-allylammonium or N-vinylammonium compounds I and component B is at least three, in particular from three to seven, acetylenically unsaturated compounds II.

Furthermore, the mixtures of the components A and B can be used together with other customary brighteners, for example with saccharin, allylsulfonic acid or alkali metal or ammonium salts thereof, vinylsulfonic acid or alkali metal or ammonium salts thereof, bisbenzenesulfonylimide or commercial brighteners based on a thio compound.

The aqueous acidic nickel electrolyte baths used contain one or usually more than one nickel salt, for example nickel sulfate and nickel chloride, one or more inorganic acids, preferably boric acid and sulfuric acid, as brighteners the mixture of components A and B alone or combined with further, customary brighteners and optionally further customary auxiliaries and additives in the concentrations customary therefor, for example wetting agents and pore inhibitors. Customary aqueous acidic nickel electrolytes ("Watts elektrolytes") have the following basic composition:

200–350 g/l of $NiSO_4 \cdot 7\ H_2O$
30–150 g/l of $NiCl_2 \cdot 6\ H_2O$
30–50 g/l of $H_3BO_3$.

The electrolyte bath pH is customarily within the range from 3 to 6, preferably within the range from 4 to 5. This pH is conveniently set with a strong mineral acid, preferably sulfuric acid.

The mixture of components A and B is present in the electrolyte baths in low concentrations, in general within the range from 0.05 to 1.0 g/l, preferably within the range from 0.1 to 0.5 g/l. The concentrations of further, customary brighteners are in each case normally within the range from 0.1 to 10 g/l, in particular from 0.1 to 2.0 g/l.

The nickel electrolyte baths described above can be used to electroplate in particular nickel coatings onto shaped articles made of steel, but also onto shaped articles made of other materials, for example brass, which have been pretreated as usual. The electroplating is in general carried out at from 30° to 80° C., preferably at from 40° to 60° C.

The present invention also provides a brightener mixture for aqueous acidic baths for the electrodeposition of nickel, comprising a mixture of A) from 2 to 98% by weight of one or more cyclic N-allylamonium or N-vinylammonium compounds of the general formula I

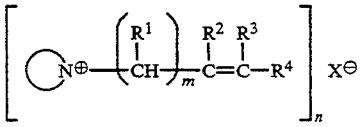

(I)

where the nitrogen atom is part of a pyridine, quinoline or isoquinoline ring system which may additionally carry one or two $C_1$- to $C_4$-alkyl substituents or halogen atoms, $R^1$, $R^3$ and $R^4$ are each hydrogen or $C_1$- to $C_4$-alkyl, $R^2$ is hydrogen or methyl, m is from 0 to 4, n is from 1 to 4, and $X^{\ominus}$ is an n-valent inorganic or organic anion which promotes solubility in water, and B) from 98 to 2% by weight of one or more acetylenically unsaturated compounds of the general formula II $$R^4—C{\equiv}C—R^5 \quad \text{(II)}$$

where $R^4$ and $R^5$ are identical or different and each is $C_1$- to $C_4$-alkyl substituted by hydroxyl, sulfo, amino, $C_1$- to $C_4$-alkylamino or di($C_1$- to $C_4$-alkyl)amino, although hydroxyl groups may have been reacted with from 1 to 10 mol of a $C_2$- to $C_4$-alkylene oxide or a mixture of such alkylene oxides and one of the radicals $R^4$ and $R^5$ may also be hydrogen or $C_1$-to $C_4$-alkyl.

The brightener mixture of the invention is notable for extremely powerful brightening. In general it produces better brightness and better planarization than the customary brighteners at a distinctly lower concentration in the nickel electrolyte bath.

USE EXAMPLES

The mixtures listed in the Table below as Examples 1 to 11 were used as brighteners in weakly acidic electroplating baths for the deposition of nickel.

The aqueous nickel electrolyte used had the following composition:

300 g/l of $NiSO_4.7\ H_2O$ 60 g/l of $NiCl_2.6\ H_2O$ 45 g/l of $H_3BO_3$ 0.5 g/l of a fatty alcohol derivative of the formula $C_{12}H_{25}/C_{14}H_{29}—O—(CH_2CH_2O)_2—SO_3Na$ as wetting agent.

The respective brightener concentrations are indicated below in the Table.

The pH of the electrolyte was set to 4.2 with sulfuric acid.

Brass panels were used. Prior to being coated with nickel they had been cathodically degreased in a conventional manner in an alkaline electrolyte. They were nickelized in a 250 ml Hull cell at 55° C. with a current strength of 2A over a period of 10 minutes. The panels were then rinsed with water and dried with compressed air.

The Table below shows the results of these experiments. It can be seen that the brightener mixture of the invention produced better brightness and planarization than the prior art brighteners, in some instances at a distinctly lower concentration in the nickel electrolyte bath.

TABLE

Test results of electronickelization

| Ex. No. | Brightener | Concentration [g/l] | Brightness [rating] | Planarization [rating] |
|---|---|---|---|---|
| 1 | Component A: N-allylpyridinium chloride | 0.1 | 5 | 2 |
| | Component B: but-2-yne-1,4-diol | 0.15 | | |
| | further brighteners: saccharin | 2 | | |
| 2 | Component A: N-allylpyridinium chloride | 0.1 | 5 | 2 |
| | Component B: but-2-yne-1,4-diol mono-propoxylate | 0.25 | | |
| | further brighteners: sodium allylsulfonate | 6 | | |
| 3 | Component A: N-allylpyridinium chloride | 0.1 | 5 | 2 |
| | Component B: | | | |
| | but-2-yne-1,4-diol | 0.1 | | |
| | prop-2-yn-1-ol | 0.02 | | |
| | prop-2-yn-1-ol ethoxylate | 0.04 | | |
| | further brighteners: | | | |
| | saccharin | 2 | | |
| | sodium allylsulfonate | 4 | | |
| | bisbenzenesulfonylimide | 0.5 | | |
| 4 | Component A: N-allylpyridinium chloride | 0.1 | 5 | 2 |
| | Component B: | | | |
| | but-2-yne-1,4-diol mono-propoxylate | 0.08 | | |
| | prop-2-yn-1-ol ethoxylate | 0.015 | | |
| | but-2-yne-1,4-diol diethoxylate | 0.015 | | |
| | further brighteners: | | | |
| | saccharin | 2 | | |
| | sodium allylsulfonate | 4 | | |
| 5 | Component A: N-allylpyridinium chloride | 0.1 | 5 | 2 |
| | Component B: | | | |
| | prop-2-yn-1-ol | 0.01 | | |
| | but-2-yne-1,4-diol mono-propoxylate | 0.08 | | |
| | prop-2-yne-1-sulfonic acid, sodium salt | 0.05 | | |
| | prop-2-yn-1-ol propoxylate | 0.02 | | |
| | further brighteners: | | | |
| | saccharin | 2 | | |
| | sodium allylsulfonate | 4 | | |
| 6 | Component A: N-allylpyridinium chloride | 0.1 | 5 | 2 |
| | Component B: | | | |
| | prop-2-yn-1-ol ethoxylate | 0.015 | | |
| | but-2-yne-1-4-diol mono-ethoxylate | 0.015 | | |
| | 1-diethylamino-prop-2-yne | 0.01 | | |
| | prop-2-yne-1-sulfonic acid, sodium salt | 0.1 | | |
| | prop-2-yn-1-ol propoxylate | 0.01 | | |
| | further brighteners: | | | |

TABLE-continued

Test results of electronickelization

| Ex. No. | Brightener | Concentration [g/l] | Brightness [rating] | Planarization [rating] |
|---|---|---|---|---|
| | saccharin | 2 | | |
| | sodium vinylsulfonate | 1 | | |
| | bisbenzenesulfonylimide | 0.5 | | |
| | commercial brightener based on a thio compound | | | |
| 7 | Component A: N-allylpyridinium chloride | 0.1 | 5 | 2 |
| | Component B: | | | |
| | prop-2-yn-1-ol | 0.015 | | |
| | prop-2-yn-1-ol ethoxylate | 0.02 | | |
| | but-2-yne-1,4-diol monopropoxylate | 0.05 | | |
| | but-2-yne-1,4-diol monoethylate | 0.01 | | |
| | 1-diethylamino-prop-2-yne | 0.01 | | |
| | prop-2-yne-1-sulfonic acid, sodium salt | 0.03 | | |
| | prop-2-yn-1-ol propoxylate | 0.01 | | |
| | further brighteners: | | | |
| | saccharin | 2 | | |
| | sodium vinylsulfonate | 0.8 | | |
| | bisbenzenesulfonylimide | 0.05 | | |
| | commercial brightener based on a thio compound | 0.1 | | |
| 8 | Component A: N-methallylpyridinium chloride | 0.1 | 5 | 2 |
| | Component B: | | | |
| | but-2-yne-1,4-diol monopropoxylate | 0.08 | | |
| | but-2-yne-1,4-diol monoethoxylate | 0.015 | | |
| | prop-2-yn-1-ol ethoxylate | 0.015 | | |
| | further brighteners: | | | |
| | saccharin | 2 | | |
| | sodium allylsulfonate | 4 | | |
| 9 | Component A: N-methallylpyridinium chloride | 0.1 | 5 | 2 |
| | Component B: | | | |
| | prop-2-yn-1-ol | 0.01 | | |
| | but-2-yne-1,4-diol monopropoxylate | 0.08 | | |
| | prop-2-yne-1-sulfonic acid, sodium salt | 0.05 | | |
| | prop-2-yn-1-ol ethoxylate | 0.02 | | |
| | further brighteners: | | | |
| | saccharin | 2 | | |
| | sodium allylsulfonate | 4 | | |
| 10 | Component A: N-allylpyridinium chloride | 0.1 | 5 | 2 |
| | Component B: prop-2-yne-1-sulfonic acid, sodium salt | 0.25 | | |
| 11 | Component A: N-methallylpyridinium chloride | 0.1 | 5 | 2 |
| | Component B: prop-2-yne-1-sulfonic acid, sodium salt | 0.25 | | |
| For comparison: | | | | |
| A | N-allylpyridinium chloride | 0.1 | 4 | 1 |
| | sodium allylsulfonate | 6 | | |
| B | N-methallylpyridinium chloride | 0.1 | 4 | 1 |
| | Sodium allylsulfonate | 6 | | |

Comparative mixtures A and B are known from reference (3).

Rating Scheme for Brightness

5=excellent (perfect specular gloss)
4=good (virtually specular gloss)
3=moderate
2=poor
1=no brightness Rating scheme for planarization 2=high
1=medium
0=moderate

We claim:

1. A process for producing nickelized shaped articles by electrodeposition of nickel from aqueous acidic baths containing as essential constituents one or more nickel salts, one or more inorganic acids and at least two brighteners, which comprises using as brighteners a mixture of A) from 2 to 98% by weight of one or more cyclic N-allylammonium or N-vinylammonium compounds of the general formula I

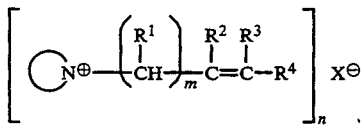

(I)

where the nitrogen atom is part of a pyridine, quinoline or isoquinoline ring system which may additionally carry one or two $C_1$- to $C_4$-alkyl substituents or halogen atoms, $R^1$, $R^3$ and $R^4$ are each hydrogen or $C_1$- to $C_4$-alkyl, $R^2$ is hydrogen or methyl, m is from 0 to 4, n is from 1 to 4, and $X^\ominus$ is an n-valent inorganic or organic anion which promotes solubility in water, and B) from 98 to 2% by weight of one or more acetylenically unsaturated compounds of the general formula II $$R^4—C≡C—R^5 \quad (II)$$

where $R^4$ and $R^5$ are identical or different and each is $C_1$- to $C_4$-alkyl substituted by hydroxyl, sulfo, amino, $C_1$- to $C_4$-alkylamino or di($C_1$- to $C_4$-alkyl-)amino, although hydroxyl groups may have been reacted with from 1 to 10 mol of a $C_2$- to $C_4$-alkylene oxide or a mixture of such alkylene oxides and one of the radicals $R^4$ and $R^5$ may also be hydrogen or $C_1$-to $C_4$-alkyl.

2. A process for producing nickelized shaped articles as claimed in claim 1, wherein component A comprises cyclic N-allylammonium compounds of the general formula Ia

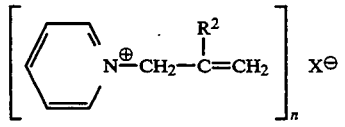

(Ia)

where $R^2$, n and $X^\ominus$ are each as defined above.

3. A process for producing nickelized shaped articles as claimed in claim 1, wherein component B comprises acetylenically unsaturated compounds II where $R^4$ and $R^5$ are identical or different and each is hydroxyl-, sulfo-, dimethylamino- or diethylamino-substituted methyl or ethyl, although hydroxyl groups may have been reacted with from 1 to 3 mol of a $C_2$- to $C_4$-alkylene oxide or a mixture of such alkylene oxides and one of the radicals $R^4$ and $R^5$ may also be hydrogen, methyl or ethyl.

4. A process for producing nickelized shaped articles as claimed in claim 1, wherein component A is a mixture of one or more cyclic N-allyammonium or N-vinylammonium compounds I and component B is at least three acetylenically unsaturated compounds II.

5. A brightener mixture for aqueous acidic electronickelizing baths, comprising a mixture of A) from 2 to 98% by weight of one or more cyclic N-allylammonium or N-vinylammonium compounds of the general formula I

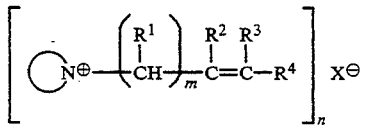

(I)

where the nitrogen atom is part of a pyridine, quinoline or isoquinoline ring system which may additionally carry one or two $C_1$- to $C_4$-alkyl substituents or halogen atoms, $R^1$, $R^3$ and $R^4$ are each hydrogen or $C_1$- to $C_4$-alkyl, $R^2$ is hydrogen or methyl, m is from 0 to 4, n is from 1 to 4, and $X^{\ominus}$ is an n-valent inorganic or organic anion which promotes solubility in water, and B) from 98 to 2% by weight of one or more acetylenically unsaturated compounds of the general formula II $$R^4—C{\equiv}C—R^5 \qquad \text{(II)}$$

where $R^4$ and $R^5$ are identical or different and each is $C_1$- to $C_4$-alkyl substituted by hydroxyl, sulfo, amino, $C_1$- to $C_4$-alkylamino or di($C_1$- to $C_4$-alkyl-)amino, although hydroxyl groups may have been reacted with from 1 to 10 mol of a $C_2$- to $C_4$-alkylene oxide or a mixture of such alkylene oxides and one of the radicals $R^4$ and $R^5$ may also be hydrogen or $C_1$-to $C_4$-alkyl.

* * * * *